US007457555B2

(12) United States Patent
Nakamura

(10) Patent No.: US 7,457,555 B2
(45) Date of Patent: Nov. 25, 2008

(54) INJECTION CHARGING DEVICE PROMOTING UNIFORM CHARGING OF AN IMAGE BEARING MEMBER

(75) Inventor: Ryo Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 11/409,084

(22) Filed: Apr. 24, 2006

(65) Prior Publication Data

US 2006/0245774 A1 Nov. 2, 2006

(30) Foreign Application Priority Data

May 2, 2005 (JP) ..... 2005-134014
Mar. 30, 2006 (JP) ..... 2006-094437

(51) Int. Cl.
*G03G 15/02* (2006.01)

(52) U.S. Cl. ..... 399/50; 399/174

(58) Field of Classification Search ..... 399/50, 399/174–176

See application file for complete search history.

(56) References Cited

U.S. PATENT DOCUMENTS 6,909,859 B2 6/2005 Nakamura et al. ..... 399/50
7,103,303 B2 9/2006 Suzuki et al. ..... 399/175
2003/0228172 A1* 12/2003 Nakamura et al. ..... 399/174
2005/0008396 A1 1/2005 Nakamura et al. ..... 399/175
2005/0135839 A1* 6/2005 Inoue ..... 399/175
2005/0271419 A1* 12/2005 Nakamura et al. ..... 399/175

FOREIGN PATENT DOCUMENTS

JP 2004-29361 1/2004

OTHER PUBLICATIONS

Office Action, dated Jun. 27, 2008, issued in Chinese counterpart Patent Application No. 2006100774811 and English-language translation thereof.

* cited by examiner

*Primary Examiner*—David M Gray
*Assistant Examiner*—Joseph S. Wong
(74) *Attorney, Agent, or Firm*—Fitzpatrick, Cella, Harper & Scinto

(57) ABSTRACT

An image forming apparatus includes an image bearing member; a plurality of chargers for injection charging of the image bearing member; a latent image forming device, disposed downstream of the plurality of charging members with respect to a moving direction of a peripheral surface of the image bearing member, for forming a latent image on the image bearing member having been charged by the plurality of charging members; a potential detecting device for detecting a surface potential of the image bearing member after passing by the plurality of charging members, wherein the plurality of chargers include a first charger and a second charger disposed at a most downstream position with respect to the moving direction, and wherein the image forming apparatus is operable in a control mode in which a bias voltage applied to the first charger is changed with a bias voltage applied to the second charger unchanged.

9 Claims, 8 Drawing Sheets

INJECTION CHARGING DEVICE PROMOTING UNIFORM CHARGING OF AN IMAGE BEARING MEMBER

FIELD OF THE INVENTION AND RELATED ART

The present invention relates to an image forming apparatus which is controllable in the electrical potential level of its image bearing member.

In the field of an electrophotographic image forming apparatus, a charging apparatus employing a charging method based on corona discharge has been the most commonly used as a charging apparatus for charging an image bearing member. However, in recent years, a charging apparatus employing a charging method of the contact type, which enjoys the merit of being smaller not only in the amount of the by-product of electrical discharge such as ozone, and also, in the amount of electric power consumption, has been increased in the amount of research and development. Further, some of the charging apparatuses employing the charging method of the contact type have been put to practical use.

A charging method of the contact type is such a charging method that charges an image bearing member by placing a charging means such as a charge roller in contact with the image bearing member, and applying voltage to the charging means. As one of the charging apparatus of this type, a charging apparatus employing a magnetic brush as the charging means of the contact type has been used, because of its superiority in the state of contact between the charging means and image bearing member.

In a charging apparatus employing a magnetic brush, electrically conductive magnetic particles are magnetically confined directly on the surface of a magnet, or the surface of a sleeve which contains a magnet, so that the magnetic particles are placed in contact with the surface of an image bearing member. The image bearing member is charged by a applying voltage to the sleeve.

With the use of a charging apparatus employing a magnetic brush, the peripheral surface of an image bearing member can be charged to virtually the same potential level as the potential level of the DC component of the bias applied to the magnetic brush. Incidentally, as an image bearing member chargeable with a magnetic brush-based charging apparatus, there are an ordinary organic photosensitive member provided with a surface layer in which electrical conductive microscopic particles have been dispersed, and a photosensitive member formed of amorphous silicon or the like (which hereinafter may be referred to as a-Si photosensitive member), for example. In the case of an ordinary charging method based on corona discharge, the peripheral surface of a photosensitive member is not charged unless the potential level of the bias applied to a charging member is higher than the starting level bias. This is why a charging method based on corona discharge is referred to as charging method based on an electrical discharge. In comparison, a charging method employing a magnetic brush is referred to as charging method based on charge injection. Hereinafter, therefore, a method for charging an object by injecting an electrical charge into the object with the use of a charging apparatus employing a magnetic brush will be referred to as magnetic brush-based charge injecting method.

A magnetic brush-based charge injecting method does not rely on electrical discharge, on which a charging method based on corona discharge relies, in order to charge a photosensitive member. Therefore, it is smaller than a charging method based on corona discharge, in the amount of ozone production and power consumption. It also enjoys the merit of not causing, even in an environment which is high in humidity and temperature, the problem that a defective image having an appearance of flowing water is formed due to the presence of the by-products of electrical discharge.

Further, a photosensitive member based on amorphous silicon or the like is higher in hardness than an organic photosensitive member. Therefore, it is longer in service life, being therefore possibly capable of reducing an image forming apparatus in operational cost.

As will be evident from the description of a magnetic brush-based charging injection method and a photosensitive member based on amorphous silicon or the like, the combination of the two can provide an image forming system which is superior in durability and safety.

However, a photosensitive member based on amorphous silicon or the like is made up of an aluminum cylinder and a solid film of amorphous silicon or the like formed on the peripheral surface of an aluminum cylinder by depositing amorphous silicon or the like on the peripheral surface of the aluminum cylinder with the use of plasma generated by heating gas with the use of high frequency waves or microwaves. Therefore, unless the plasma is uniform, a photosensitive drum which is nonuniform in the thickness and/or composition of the amorphous silicon layer, in terms of the circumferential direction of the photosensitive member, is yielded.

Compared to an organic photosensitive member, a photosensitive member based on amorphous silicon or the like is very large in the amount by which its surface potential attenuates after the charging of the photosensitive member, even if it is not exposed to light. In addition, it is also greater in the amount by which its surface potential is made to attenuate by the optical memory resulting from the exposure of the photosensitive member to an optical image. Therefore, an image forming apparatus employing a photosensitive member based on amorphous silicon or the like needs to be equipped with a pre-exposing means, that is, a means for exposing a photosensitive member to erase the optical memory resulting during the preceding rotation of the photosensitive member. In other words, a photosensitive member based on amorphous silicon or the like is very large in electrical potential attenuation; its electrical potential attenuation is in the range of 100-200 V. Thus, the above-mentioned nonuniformity in the thickness of the photosensitive layer of an a-Si photosensitive member or the like results in the nonuniformity in the potential level of the photosensitive drum, in terms of the circumferential of the photosensitive member, and this nonuniformity is in the range of 10 -20 V.

An a-Si photosensitive member, which is larger in electrostatic capacity than an ordinary organic photosensitive member, is affected more by this type of nonuniformity in potential level than an ordinary organic photosensitive member, because the former is smaller in contrast than the latter. Therefore, if this type of nonuniformity in electrical potential occurs to an a-Si photosensitive member, an image which is conspicuously nonuniform in density is formed.

As one of the countermeasures against this problem, it is effective to provide an image forming apparatus with multiple magnetic brush-based charging apparatuses in order to charge an image bearing member multiple times. The amount by which a photosensitive member attenuates in electrical potential due to the presence of the aforementioned optical memory can be substantially reduced by charging the image bearing member multiple times. More specifically, as the image bearing member is charged by a first charging apparatus, that is, the upstream charging apparatus in terms of the moving direction of the peripheral surface of the image bearing member, the optical memory is substantially reduced. Thus, the electrical charge given to the image bearing member by a second charging apparatus, that is, the charging apparatus located on the downstream side of the first charging apparatus, is substantially smaller in the amount of the non-exposure electrical potential attenuation than the electrical charge given by the first charging apparatus.

For example, Japanese Laid-open Patent Application 2004-029361 proposes to make the charge bias for the upstream charging apparatus, in terms of the moving direction of the peripheral surface of the image bearing member, higher than the charge bias for the downstream charging apparatus, in order to make the downstream charging apparatus smaller in the amount of charge current than the upstream charging apparatus. With the employment of this type of structural arrangement, the downstream charging means is rendered more effective to make the peripheral surface of the image bearing member uniform in potential level, making it therefore possible to yield an excellent image, that is, an image excellent in that it does not suffer from density anomaly.

However, in order to improve a charging apparatus in terms of the stability in image density, it is necessary to precisely control various parameters in each of the charging process, exposing process, developing process, transferring process, fixing process, etc.

Regarding the charging process, for example, in the case of the bias control table with which an ordinary electrophotographic image forming apparatus is provided to control the bias applied from a high voltage power source, the minimum increment by which the charge bias can be changed is several volts. Therefore, there is the problem that it is difficult to finely adjust the photosensitive member in surface potential level, in particular, when it is necessary to finely adjust the photosensitive member in surface potential level, in order to compensate for the deviation in the surface potential level which occurs during an image forming operation in which a substantial number of copies are continuously outputted.

SUMMARY OF THE INVENTION

The primary object of the present invention, which was made in consideration of the above described problem, is to make it possible to finely adjust the surface potential level of an image forming apparatus provided with multiple charging means for charging an image bearing member, in order to keep stable the surface potential level of the photosensitive member by compensating for the changes in the surface potential level of the photosensitive member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
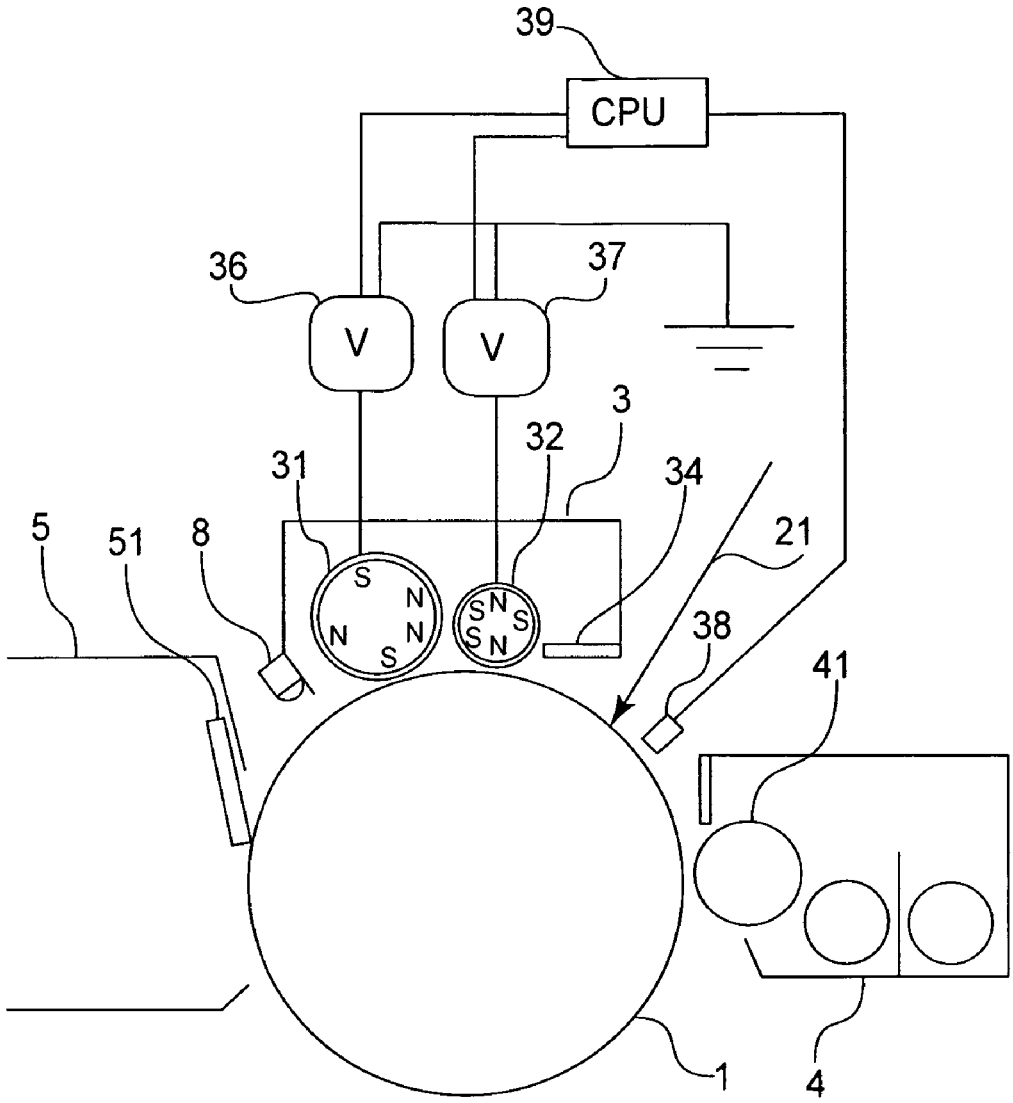
FIG. 1 is a schematic drawing of the essential portions of the image forming apparatus according to a first embodiment of the present invention.
Figure 2:
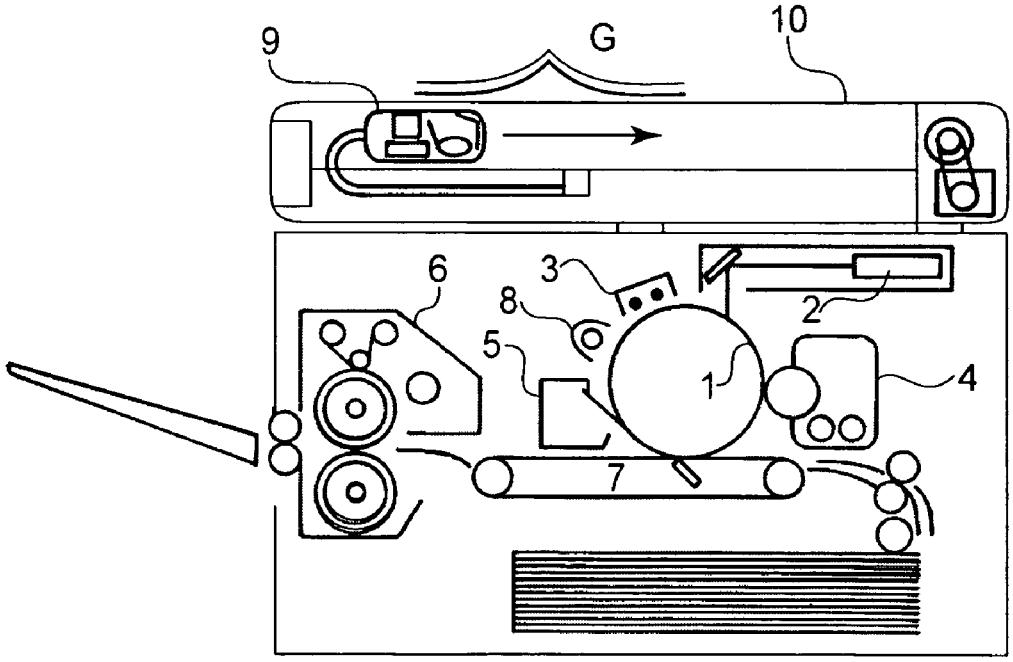
FIG. 2 is a schematic drawing of the image forming apparatus in the first embodiment of the present invention.

First, referring to FIGS. 1 and 2, the general structure and operation of the image forming apparatus in this embodiment will be briefly described.

As a copy start signal is inputted into the image forming apparatus, electrical charge is injected into the electrophotographic photosensitive member 1 (which hereinafter will be referred to as photosensitive drum 1), as an image bearing member, in the form of a drum by a magnetic brush-based charging apparatus 3 so that the potential of the peripheral surface of the photosensitive drum 1 changes to a preset level. Here, "injecting electrical charge" means such a process that can charge the photosensitive drum 1 to a potential level which is roughly the same as that of the DC component of the bias applied to the magnetic brush-based charging apparatus, as described above. An original G placed on an original placement table 10 is scanned, while being illuminated, by a unit 9 made up of an original illuminating lamp, a lens array with a short focal point, and a CCD sensor. As the original G is scanned, the light reflected by the original G is focused by the lens array with a short focal point, on the CCD sensor, being inputted into the CCD sensor, which is made up of a light catching portion, a transfer portion, and an output portion. As the optical signals are inputted into the CCD sensor, they are converted into signals in the form of electric charge, which are sequentially transferred by the transfer portion to the output portion in synchronism with clock pulses. Then, the signals in the form of electric charge are converted into voltage signals, amplified, and reduced in impedance, in the signal output portion, and then, are outputted as analog signals from the output portion. The thus obtained analog signals are converted by one of the known imaging processes into digital signals, which are transferred to a printer portion. In the printer portion, the peripheral surface of the photosensitive drum 1 is exposed by a laser-based exposing apparatus 2 (latent image forming apparatus) made up of a laser, which is turned on or off in response to the above-mentioned image formation signals. As a result, an electrostatic latent image reflecting the original G is formed on the peripheral surface of the photosensitive drum 1.

Next, the electrostatic latent image is developed by a developing device 4, in which developer (which contains toner and magnetic particles) is stored. As a result, a visible image is formed of toner, on the peripheral surface of the photosensitive drum 1 (this visible image formed of toner hereafter will be referred to simply as toner image). The toner image having just been formed on the photosensitive drum 1 through the above-described steps is electrostatically transferred by a transferring apparatus 7 onto a sheet of transfer medium. Thereafter, the transfer medium is electrostatically separated from the photosensitive drum 1, and then, is conveyed to a fixing device 6, in which the toner image on the transfer medium is thermally fixed to the transfer medium. Then, the recording medium bearing the fixed toner image is outputted from the image forming apparatus.

Meanwhile, the portion of the peripheral surface of the photosensitive drum 1, from which the toner image has just been transferred, is cleared by a cleaner 5 of the contaminants, such as the toner particles remaining thereon after the toner image transfer. Then, it is exposed, as necessary, by a pre-exposure lamp 8 for removing the optical memory resulting from the preceding image formation exposure, so that it can be used again for image formation; the peripheral surface of the photosensitive drum 1 is repeatedly used for image formation.

Next, the structure of each of the above-mentioned components will be described in detail. The photosensitive drum 1 employed as the image bearing member in this embodiment is a photosensitive drum based on amorphous silicon (which hereinafter will be referred to as a-Si) or the like, inherent polarity of which is negative. The photosensitive drum 1 in this embodiment based on the negatively chargeable a-Si is made up of an aluminum cylinder which is 80 mm in diameter, and four functional layers, that is, a positive charge blocking layer, a photoconductive layer, a negative charge blocking layer, and a surface protection layer, which are sequentially layered, in the listed order, on the peripheral surface of the aluminum cylinder.

Figure 3:
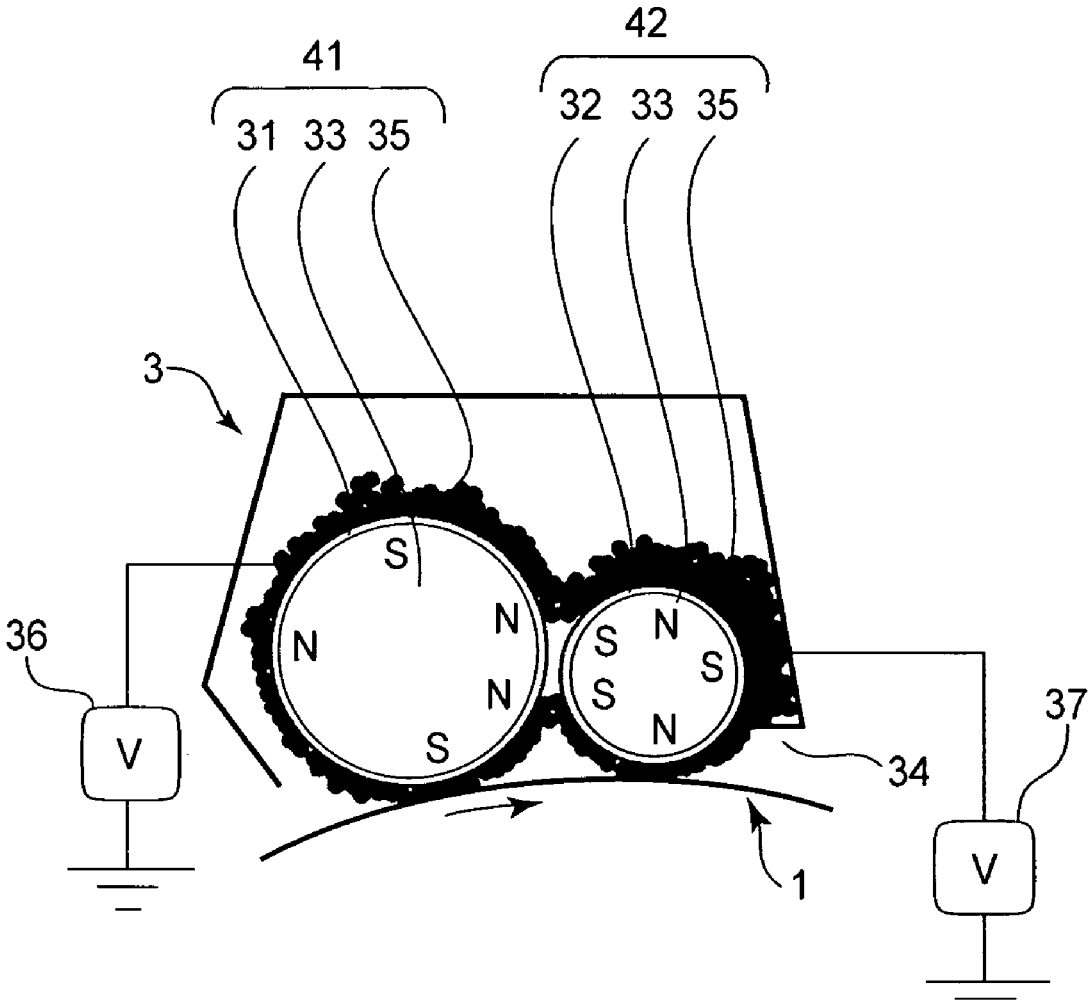
FIG. 3 is a schematic drawing of the magnetic brush-based charging device in the first embodiment of the present invention.

Next, referring to FIG. 3, the magnetic brush-based charging apparatus 3 as the charging means in this embodiment will be described. The magnetic brush-based charging apparatus 3 is provided with multiple charging devices (two, for example, as in this embodiment). Each charging device is made up of a stationary magnet 33, non-rotational nonmagnetic charge sleeve (magnetic particle bearer) 31(32), and a layer of magnetic particles 35. The stationary magnet 33 is disposed within the hollow of the charge sleeve 31(32). The layer of magnetic particles 35 is held, in the form a brush (magnetic brush), to the peripheral surface of the charge sleeve 31(32) by the magnetic field. The layer of magnetic particles 35 is held to the peripheral surface of the charge sleeve 31 so that it remains in contact with the peripheral surface of the photosensitive drum 1. The portion of the layer of magnetic particles 35, which corresponds to the tip portion of the magnetic brush, is regulated by a regulation blade 34 as a magnetic particle regulating means. As the charge sleeve (charging member) 31(32) is rotated, the magnetic particles 35 are conveyed by the charge sleeve 31(32). Here, of the two charging devices in this embodiment, the one on the downstream side in terms of the moving direction of the peripheral surface of the photosensitive drum 1 is referred to as a second charging device 42, and the other, or the one on the upstream side, is referred to as a first charging device 41. The most downstream point for the charging apparatus is set with reference to the point of the peripheral surface of the photosensitive drum 1, at which the laser-based exposing apparatus exposes the peripheral surface of the photosensitive drum 1. That is, the charging device located immediately upstream of the laser-based exposing apparatus 2 is referred to as the downstream charging device. In this embodiment, the charge sleeve 31 is referred to as a first charge sleeve, and the charge sleeve 32 is referred to as a second charge sleeve.

The charge sleeves 31 and 32 are rotated in the opposite direction from the rotational direction of the photosensitive drum 1. As charge voltages (charge biases) are applied to the charge sleeves 31 and 32, one for one, electric charge is given to the peripheral surface of the photosensitive drum 1 from the magnetic particles 35 on the charge sleeves. As a result, the photosensitive drum 1 is charged to a potential level, which is close to the value of the charge voltage.

In this embodiment, the peripheral velocity of the photosensitive drum 1 is 300 mm/sec, and the peripheral velocities of the charge sleeves 31 and 32 are 150 mm/sec. Therefore, the peripheral velocity of the photosensitive drum 1 relative to those of the charge sleeves 31 and 32 is 450 mm/sec.

The magnetic particles 35 separate from the portion of the charge sleeve 31 (32), which corresponds to the portion of the magnet 33, where the adjacent two magnetic poles are the same in polarity, that is, where the adjacent two magnetic poles repel each other. In this embodiment, the charging apparatus 3 is devised in the positioning of the magnetic poles so that as the magnetic particles 35 come to the area in which the distance between the two charge sleeves 31 and 32 is smallest, the magnetic particles 35 transfer from the charge sleeve on which they are borne to the other charge sleeve; the magnetic particles 35 do not move through the gap between the two charge sleeves 31 and 32 (FIG. 3).

In this embodiment, the two magnets 33 are disposed in the hollows of the charge sleeves 31 and 32, one for one, so that the portion of each magnet 33, which opposes the photosensitive drum 1, is roughly 900 gauss in magnetic flux density. This arrangement prevents the so-called carrier adhesion phenomenon, that is, the phenomenon that the magnetic particles 35 break free from the magnetic particle confining force of the magnet, and adhere to the peripheral surface of the photosensitive drum 1. This arrangement also prevents the problem that the surface protection layer of the photosensitive drum 1 is excessively worn by the increased friction between the magnetic particles 35 and photosensitive drum 1. In consideration of the carrier adhesion and excessive wear, the magnetic flux density of the above-mentioned portion of each magnet is desired to be no less than 500 gauss and no more than 1,300 gauss, preferably no less than 700 gauss and no more than 1,100 gauss.

The first and second charge sleeves 31 and 32 employed in this embodiment were 24 mm and 16 mm, respectively, in diameter. The gap between the charge sleeves 31 and 32 was set to roughly 300 μm, and the gap between the charge sleeve 32 and nonmagnetic regulation blade 34 was set to roughly 350 μm. In the charging means container, 50 g of magnetic particles 35 was held.

The magnetic particles 35 are desired to be 10-100 μm in average particle diameter, 20-250 emu/cm$^3$ in saturation magnetization, and $10^2$-$10^{10}$ Ω·cm in electrical resistance. For the improvement of charging performance, the magnetic particles 35 are desired to be as low as possible in electrical resistance. However, in consideration of the possibility that the photosensitive drum 1 be defective in terms of insulation, for example, it may have pin holes or the like, it is desired that the magnetic particles 35 which are no less than $10^6$ Ω·cm in electrical resistance is employed. In this embodiment, ferrite particles were used as the material for the magnetic particles 35. More specifically, the ferrite particles were adjusted in electrical resistance by oxidizing and reducing the surfaces thereof. Further, they are put through the coupling process, obtaining thereby the magnetic particles 35 which are 35 μm in average particle diameter, 200 emu/cm$^3$ in saturation magnetization, and $5\times10^6$ Ω·cm in electrical resistance.

The electrical resistance of the magnetic particles 35 in this embodiment was measured with the use of the following method: 2 g of the magnetic particles 35 was placed in a metallic cell, which was 228 $cm^2$ in bottom size. Then, the electrical resistance of the magnetic particles 35 in the metallic cell was measured while applying thereto 6.6 $kg/cm^2$ of load and 100 V of voltage.

During a charging operation, a charge bias, which is the combination of a DC voltage of −600 V, and an AC voltage (rectangular in waveform) which is 300 Vpp in peak-to-peak voltage and 1 kHz in frequency, is applied to the first charge sleeve 31 by a charge bias applying apparatus (electric power source) 36. To the second charge sleeve 32, a charge bias which is the combination of a DC voltage of −600 V, and an AC voltage (rectangular in waveform) which is 300 Vpp in peak-to-peak voltage and 1 kHz in frequency, is applied by a charge bias applying apparatus (electric power source) 37.

Next, the developing apparatus 4 will be described. The development sleeve 41 contains a magnetic roller. The peripheral surface of the development sleeve 41 is coated with developer. As development bias is applied using an electric power source (unshown) for the developing device, a toner image is formed on the photosensitive drum 1. The development sleeve 41 is rotated in the same direction as the photosensitive drum 1. Its peripheral velocity is roughly 450 mm/sec. The developer is two-component developer, which is the mixture of toner particles and magnetic particles. The toner particles are roughly 7 μm in particle diameter, and their inherent polarity is negative. The magnetic particles are roughly 35 μm in particle diameter. The toner density in terms of weight is 8%. The toner density is controlled based on the toner density data detected by an optical toner density sensor (unshown); the toner in a toner hopper (unshown) is supplied, as necessary, into the developing device 4 to keep the developer in the developing device 4 constant in toner density.

As the cleaner 5, a 2 mm-thick cleaning blade 51 formed of urethane is employed. The photosensitive drum 1 is cleaned by scraping down the toner remaining on the photosensitive drum 1 after the toner image transfer therefrom, by the cleaning blade 51.

As the pre-exposure lamp 8, an LED which is 660 mm in wavelength is employed. The peripheral surface of the photosensitive drum 1 is exposed by a luminous energy of roughly 370 Lux.sec.

This embodiment is characterized in that the DC component of the charge bias applied to the first charge sleeve 31 is controlled with the use of a controlling apparatus (CPU) 39 so that during the period between the sequential formation of two copies (during recording medium interval), the output of a surface potential level detecting apparatus 38 has a preset value: the electrical potential of the peripheral surface of the photosensitive drum 1 is controlled so that it remains stable at a preset level. With the employment of this control method, the electrical surface potential of the photosensitive drum 1 can be adjusted to keep it stable. It should be noted here that this control method is effective to make an adjustment by an increment of several volts. Further, it is even more effective against the fluctuation of the potential level of the photosensitive drum 1 which is likely to occur when a substantial number of copies are continuously made; the surface potential of the photosensitive drum 1 can be very finely controlled in magnitude, without triggering a large amount of change in surface potential level.

Figure 4:
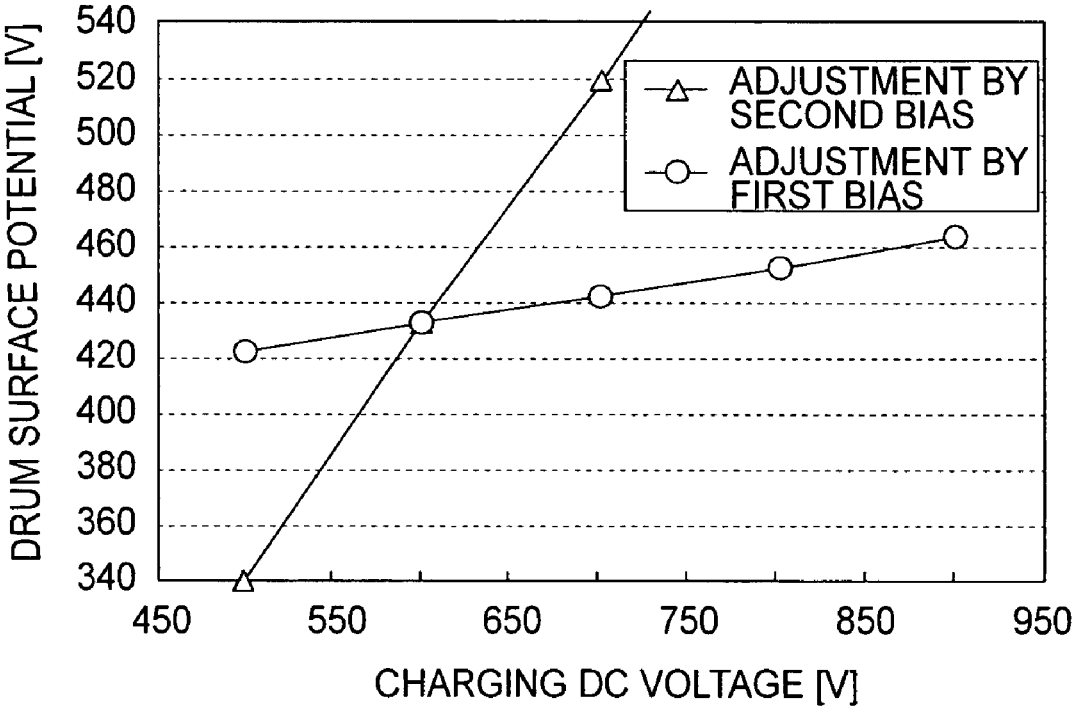
FIG. 4 is the first graph showing the results of the measurement of the drum surface potential level in the first embodiment of the present invention.

Next, the characteristic of this embodiment will be described in more detail. FIG. 4 is a graph showing the relationship between the magnitude of the DC component applied to the first and second charge sleeves 32 and 31, and the potential level to which the peripheral surface of the photosensitive drum 1 was charged. More specifically, FIG. 4 shows the changes (first charge bias adjustment in FIG. 4) which occurred to the potential level of the peripheral surface of the photosensitive drum 1 as the DC component of the charge bias applied to the first charge sleeve 31 (which hereinafter will be referred to as first charge DC voltage) is varied in magnitude, without varying in magnitude the DC component of the charge bias applied to the second charge sleeve 32 (which hereinafter will be referred to as second charge DC voltage), and the changes (second charge bias adjustment in FIG. 4) which occurred to the potential level of the peripheral surface of the photosensitive drum 1 as the second charge DC voltage is varied in magnitude without varying the first charge DC voltage in magnitude.

As for the concrete conditions, when adjusting the first charge bias, the DC voltage applied to the first charge sleeve 31 was rendered variable, whereas the DC voltage applied to the second charge sleeve 32 was kept at 600 V. It should be noted here that to both the first and second charge sleeves, an AC voltage which is 300 V in peak-to-peak voltage and 1 kHz in frequency was applied in combination with the DC voltages applied thereto.

When adjusting the second charge bias, the DC voltage applied to the second charge sleeve 32 was rendered variable, whereas the DC voltage applied to the first charge sleeve 31 was kept at 600 V. Also in this case, the AC voltage which is 300 V in peak-to-peak voltage and 1 kHz in frequency was applied to both the first and second charge sleeves, in combination with the DC voltages applied thereto.

The surface potential level of the photosensitive drum 1 was measured with the use of an electrometer Model 344 (product of Trek Co., Ltd.) as a surface potential level detecting apparatus.

Referring to FIG. 4, the changes which occurred when the first charge DC voltage was varied was smaller in magnitude than the changes which occurred when the second charge DC voltage was varied. It is evident from FIG. 4 that the surface potential level of the photosensitive drum 1 is less dependent on the first charge DC voltage than the second charge DC voltage. In other words, there is such a relationship between the first charge sleeve 31, that is, the upstream charge sleeve in terms of the moving direction of the peripheral surface of the photosensitive drum 1, and the second charge sleeve 32, that is, the charge sleeve on the most downstream charge sleeve, that the former is less than the latter, in the magnitude by which the surface potential level of the photosensitive drum 1 is changed by the change in the magnitude of the DC voltage applied to a charge sleeve.

Figure 5:
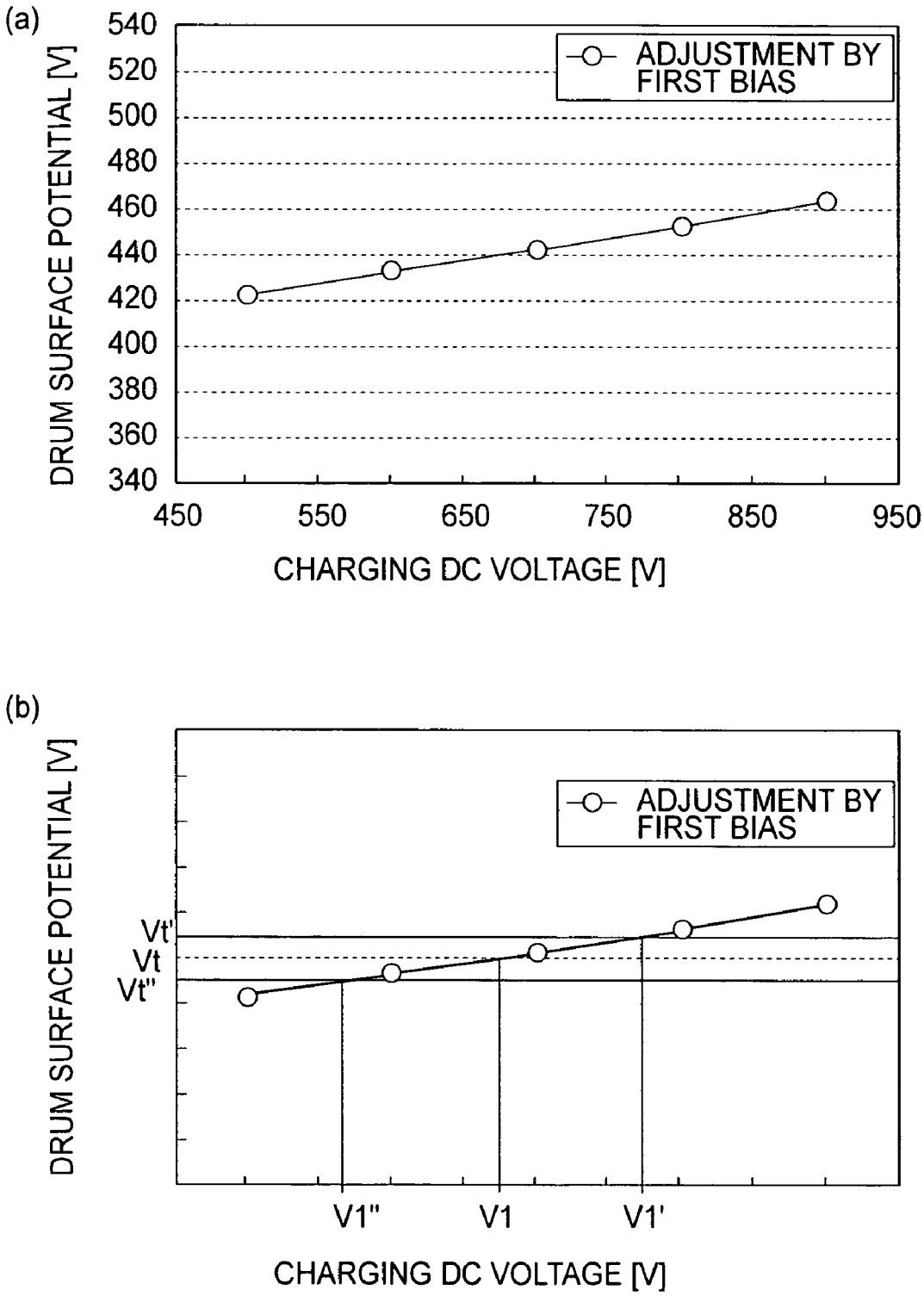
FIG. 5 is the second graph showing the results of the measurement of the drum surface potential level in the first embodiment of the present invention.

FIGS. 5(*a*) and 6(*a*) are graphs which separately show the dependency of the surface potential level of the photosensitive drum 1 upon the first charge DC voltage (first charge bias adjustment in FIG. 4), and the dependency of the surface potential level of the photosensitive drum 1 upon the second charge DC voltage (second charge bias adjustment in FIG. 4), respectively. FIGS. 5(*b*) and 6(*b*) are basically the same as FIGS. 5(*a*) and 6(*a*), respectively, except that FIGS. 5(*b*) and 6(*b*) are deprived of the numeration given in FIGS. 5(*a*) and 6(*a*), and given alphabetical referential symbols such as Vt. The referential symbol Vt represents the target value for the surface potential level of the photosensitive drum 1. It is assumed here that the surface potential level of the photosensitive drum 1 varies within a range of Vt'- Vt", and control is executed to keep the surface potential level constant at Vt.

Figure 6:
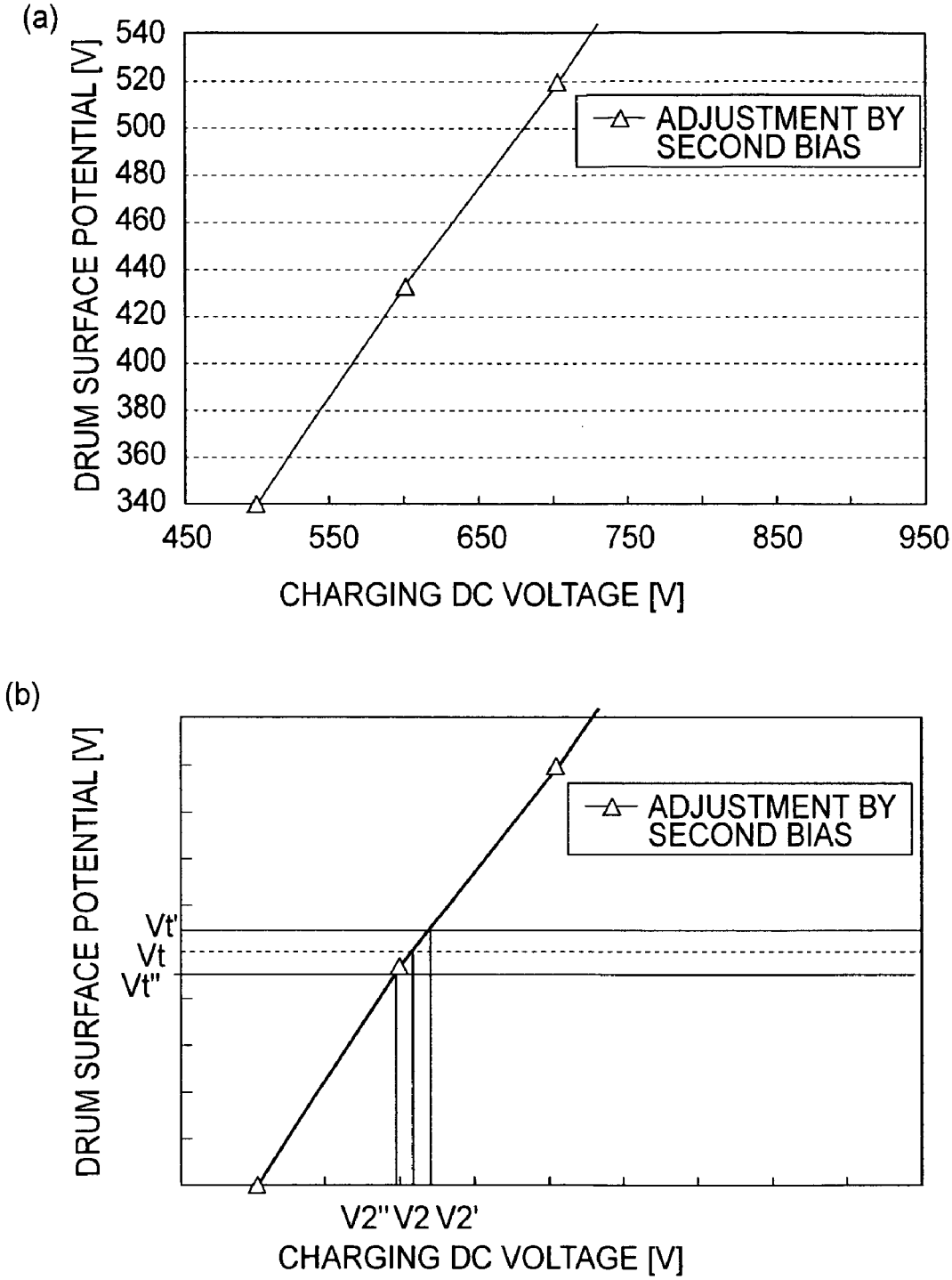
FIG. 6 is the third graph showing the results of the measurement of the drum surface potential level in the first embodiment of the present invention.

In the case in which the first charge DC voltage is varied, instead of the second charge DC voltage, in order to keep the surface potential level stable, the first charge DC voltage can be varied in the range of V1'-V1", which is relatively wide, as shown in FIG. 5. Therefore, it is easier to finely control the surface potential level. In comparison, in the case in which the second charge DC voltage is varied, instead of the fist charge DC voltage, in order to control the surface potential level of the photosensitive drum 1, the second charge DC voltage must be varied in the range of V2'-V2", which is relatively narrow as shown in FIG. 6. Therefore, it is difficult to finely adjust the surface potential level.

This is attributable to the fact that according to the table for setting the value for the bias applied from the high voltage power source, the smallest increment by which the bias can be adjusted is several volts. That is, in the case in which the relationship between the surface potential level of the photosensitive drum 1 and the magnitude of the DC voltage applied to the charge sleeve is as shown in FIG. 5, increasing the first charge DC voltage by one increment does not cause the surface potential level of the photosensitive drum 1 to drastically increase. Therefore, it is easy to finely adjust the potential level of the photosensitive drum 1 by varying the first charge DC voltage. In comparison, in the case in which the relationship between the surface potential level of the photosensitive drum 1 and the magnitude of the DC voltage applied to the charge sleeve is as shown in FIG. 6, increasing the second charge DC voltage by one increment causes the surface potential level of the photosensitive drum 1 to drastically increase. Therefore, it is difficult to finely adjust the potential level of the photosensitive drum 1 by varying the second charge DC voltage; if the amount of the deviation in the surface potential level of the photosensitive drum 1 is minute, it is impossible to properly compensate for the deviation by varying the second charge DC voltage.

The reason why the dependency of the surface potential level of the photosensitive drum 1 upon the second charge DC voltage is greater than the dependency of the surface potential level of the photosensitive drum 1 upon the first charge DC voltage is that the surface potential level of the photosensitive drum 1 is mainly dependent on the first charge DC voltage, whereas the reason why the dependency of the surface potential level of the photosensitive drum upon the first charge DC voltage is smaller is that the electrical potential given to the peripheral surface of the photosensitive drum 1 by the first charge is substantially leveled by the second charge.

Controlling the first charge bias while keeping the second charge bias constant, as in this embodiment, is effective for the control mode in which the surface potential level of the photosensitive drum 1 needs to be adjusted by several volts or so. It is even more effective to deal with the deviation in the potential level of the photosensitive drum 1, which occurs when a substantial number of copies are continuously formed. In this embodiment, it was possible to finely adjust the surface potential level of the photosensitive drum 1 without triggering the density deviation attributable to the substantial deviation in the surface potential level. Incidentally, in the rough adjustment mode in which the surface potential level of the photosensitive drum 1 needs to be adjusted by a substantial amount, the second charge DC voltage may be adjusted. Thus, the present invention is also applicable to an image forming apparatus provided with both the rough adjustment mode in which the surface potential level of the photosensitive drum 1 is substantially varied, and the fine adjustment mode in which the surface potential level of the photosensitive drum 1 is varied by a small amount.

Based on the above-described results, three tests were carried out: a test in which the first charge DC voltage was controlled using the control apparatus (CPU) 39 so that during the period between the sequential formation of two copies, the output of the surface potential level detecting apparatus 38 remained constant (at −460 V); a test in which the second charge DC voltage was controlled; and a test in which the potential level of the peripheral surface of the photosensitive drum 1 was not controlled at all. In each of the tests, the changes in potential level of the photosensitive drum 1 were examined by measuring the potential level of the photosensitive drum 1 immediately after the first, 500th, 1000th, 1500th, 2000th, 2500th and 3000th copies were made while continuously outputting 3,000 copies. Here, the potential level of the photosensitive drum 1 means the potential level detected by the surface potential level detecting apparatus 38.

In this embodiment, the electric power sources 36 and 37 were provided with such a table that allows their outputs to be varied by an increment of 5 V. When −600 V of DC voltage was initially applied to the charge sleeves 31 and 32, the drum potential level on the immediately downstream side of the magnetic brush-based charging apparatus, in terms of the moving direction of the peripheral surface of the photosensitive drum 1, was −450 V. The results of the measurements are given in the following table (Table 1). Hereafter, the control in which the voltage applied to the first charge sleeve 31 was controlled while the voltage applied to the second charge sleeve 32 was not controlled will be referred to as first charge control, whereas the control in which the voltage applied to the second charge sleeve 32 was controlled while the voltage applied to the first charge sleeve was not controlled will be referred to as second charge control. The control in which neither the voltage applied to the first charge sleeve 31 nor the voltage applied to the second charge sleeve 32 will be referred to as "no charge control".

TABLE 1

| | 1st Charge Control | 2nd Charge Control | No Charge Control |
|---|---|---|---|
| 1st | −450 | −450 | −450 |
| 500th | −450 | −449 | −449 |
| 1000th | −450 | −448 | −448 |
| 1500th | −450 | −448 | −448 |
| 2000th | −450 | −452 | −447 |
| 2500th | −450 | −451 | −446 |
| 3000th | −450 | −451 | −446 |

To briefly comment on the results of the tests, when no charge control was executed, the surface potential level of the photosensitive drum 1 gradually fell with the progression of the image outputting test. When the second charge control was executed, the surface potential level of the photosensitive drum 1 was roughly stable, remaining in the adjacencies of −450 V, although it varied within the range of several volts. In this case, up to 1500th copy, the second charge control was not executed, because varying the voltage applied to the second charge sleeve 32 by executing the second charge control changes the drum potential level by a substantial amount, causing thereby the drum potential level to deviate from −450 V by a substantial amount. In comparison, when the first charge control was executed, the surface potential level of the drum remained roughly stable at −450 V.

As will be evident from the above foregoing description of this embodiment, the surface potential level of the photosensitive drum 1 of an image forming apparatus equipped with multiple magnetic brush-based charging devices can be finely controlled by controlling the charge bias applied to the first charge sleeve 31. In other words, an image forming apparatus equipped with multiple magnetic brush-based charging devices can be further improved in the stability in the density level at which it outputs an image, and the stability in color reproduction, by controlling the charge bias applied to the first charge sleeve 31.

The control method in this embodiment is particularly effective to stabilize the surface potential level of the photosensitive drum 1, in a situation in which the surface potential level of the photosensitive drum 1 gradually deviates due to the heat, the changes in the condition of magnetic charging particles, the changes in the ambient condition, etc. For example, it is very effective to stabilize the surface potential level of the photosensitive drum 1 when a substantial number of copies are continuously produced.

Embodiment 2

In terms of the structure of an image forming apparatus, this embodiment is the same as the first embodiment. In this embodiment, however, an attempt was made to stabilize the surface potential level of the photosensitive drum 1 by altering the waveform (duty ratio) of the AC component of the first charge bias, instead of altering the magnitude of the DC component.

Figure 7:
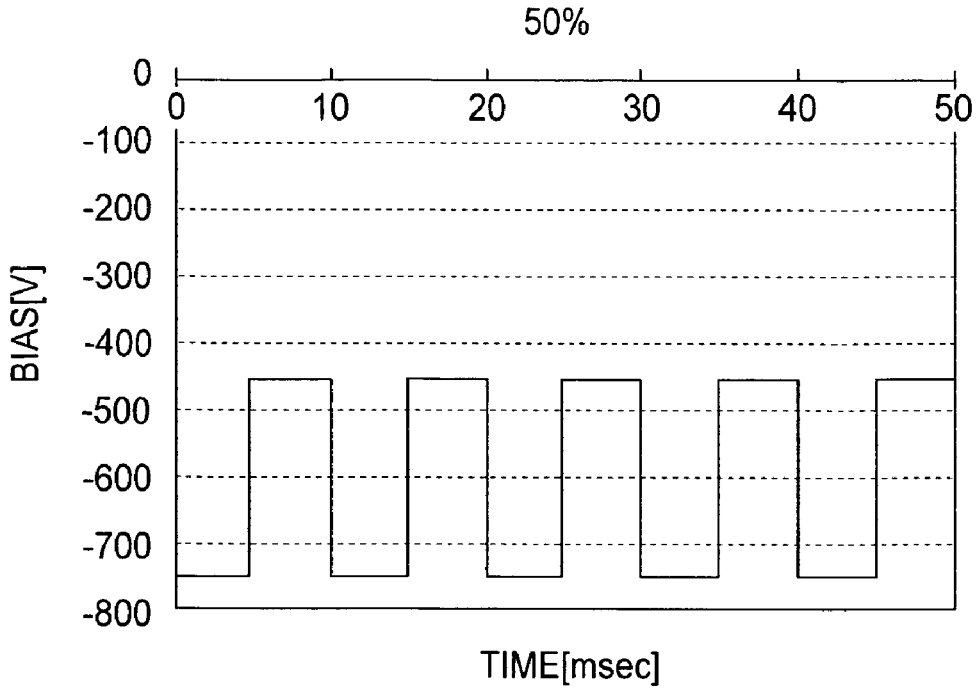
FIG. 7 is a graph showing the waveform of the bias applied according to a second embodiment of the present invention, which is 50% in duty ratio.
Figure 8:
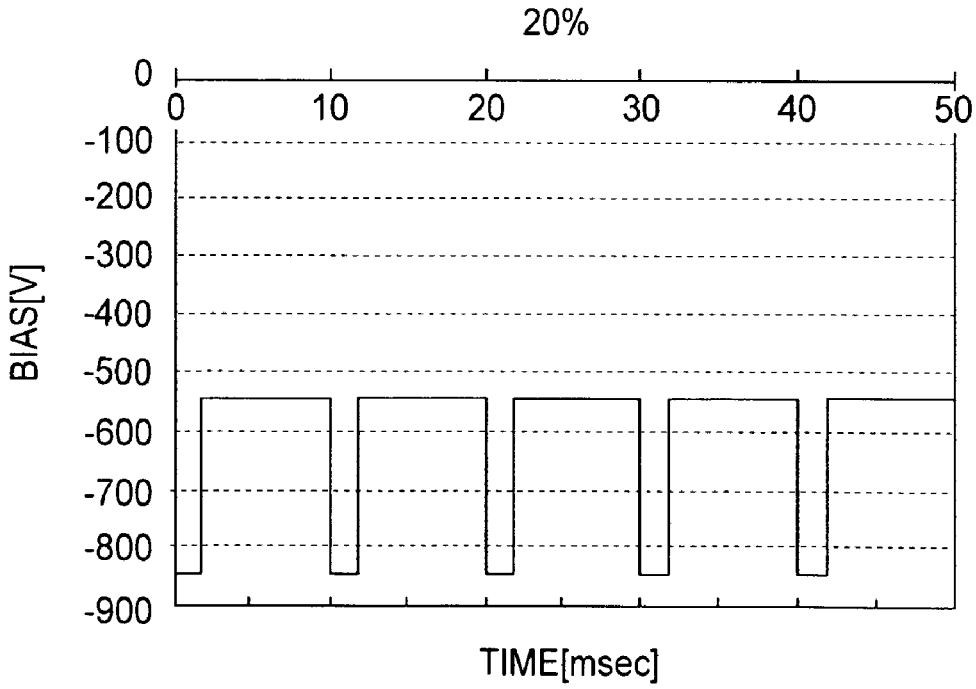
FIG. 8 is a graph showing the waveform of the bias applied in the second embodiment of the present invention, which is 20% in duty ratio.
Figure 9:
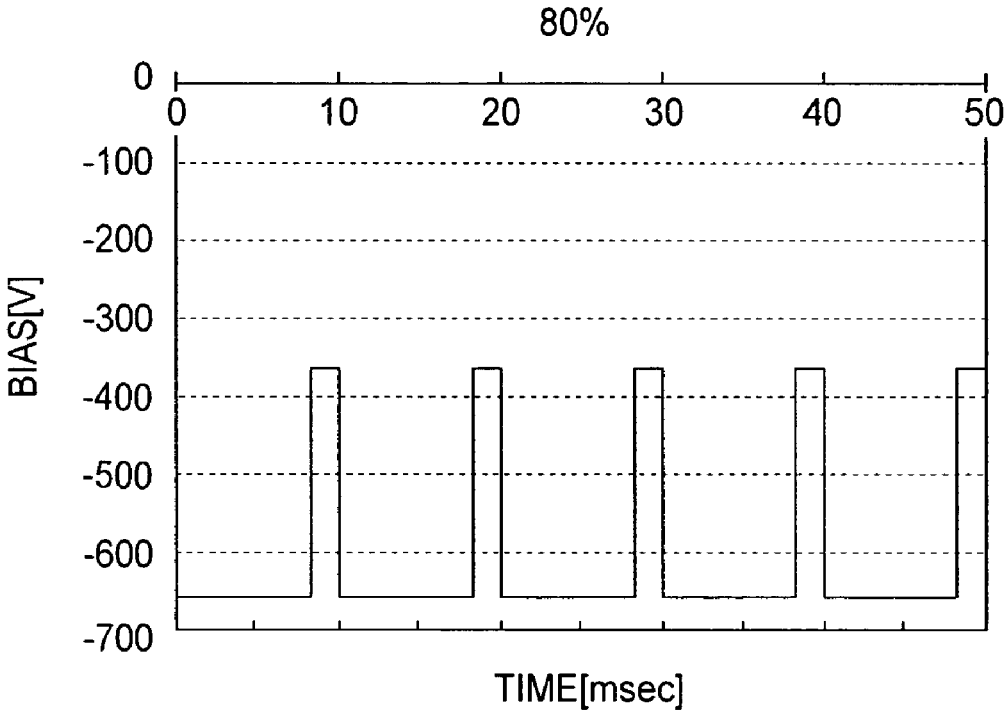
FIG. 9 is a graph showing the waveform of the bias applied in the second embodiment of the present invention, which is 80% in duty ratio.

FIGS. 7-9 show the waveforms (rectangular waveforms) of the charge biases, the duty ratios of which are 50%, 20%, and 80%, respectively. The higher the voltage applied to the magnetic charging particles 35, the lower the electrical resistance of the magnetic charging particles 35. That is, when the duty ratio of the AC voltage of applied to the first charge bias was 50%, the peripheral surface of the photosensitive drum 1 was charged to roughly −600 V, whereas when the duty ratio of the AC voltage was 20%, the peripheral surface of the photosensitive drum 1 was charged to a potential level higher than −600 V. Further, when duty ratio of the AC voltage was 80%, the peripheral surface of the photosensitive drum 1 was charged to a potential level lower than −600 V.

The image forming apparatus in this embodiment was subjected to the same three tests as those to which the image forming apparatus in the first embodiment was subjected: a test in which the first charge DC voltage was controlled using the control apparatus (CPU) 39 so that during the period between the sequential formation of two copies, the output of the surface potential level detecting apparatus 38 remained constant (at −460 V); a test in which the second charge DC voltage was controlled; and a test in which the potential level of the peripheral surface of the photosensitive drum 1 was not controlled at all. In each of the tests, the potential level of the photosensitive drum 1 was measured immediately after the first, 500th, 1000th, 1500th, 2000th, 2500th, and 3000th copies were made while continuously outputting 3,000 copies. The examinations and studies of the test results confirmed that the surface potential level of the photosensitive drum 1 can be kept roughly stable by executing the first charge control.

As described above, the surface potential level of the photosensitive drum 1 of an image forming apparatus equipped with multiple magnetic brush-based charging devices can be finely controlled by controlling the charge bias applied to the first charge sleeve 31. Therefore, an image forming apparatus equipped with multiple magnetic brush-based charging devices can be further improved in the stability in the density level at which it outputs an image, and the stability in color reproduction, by controlling the charge bias applied to the first charge sleeve 31.

The control method in this embodiment is very effective to stabilize the surface potential level of the photosensitive drum 1, in particular, in a situation in which the surface potential level of the photosensitive drum 1 gradually deviates due to the heat, the changes in the condition of magnetic charging particles, the changes in the ambient condition, etc. For example, it is very effective to stabilize the surface potential level of the photosensitive drum 1 when a substantial number of copies are continuously produced.

In the preceding embodiments, the DC voltage of the first charge bias, and the duty ratio of the waveform of the AC voltage, were selected as the control parameters. However, the control parameter does not need to be limited to the foregoing two parameters. All that is necessary to realize the effects of the present invention is that the potential level to which the peripheral surface of a photosensitive drum is charged can be controlled by the upstream charging means of the contact type, instead of the most downstream charging means of the contact type, in terms of the moving direction of the peripheral surface of the photosensitive drum. For example, the amplitude of the AC voltage of the first charge bias is also effective as the control parameter.

In the preceding embodiments, two charging means of the contact type were employed. However, the number of the charging means of the contact type does not need to be limited to two. That is, the present invention is also applicable to an image forming apparatus employing three or more charging means of the contact type. In the case of an image forming apparatus employing three or more charging means of the contact type, the charging means which is controlled in the charge bias is to be the charging means which is not the most downstream charging means, in terms of the moving direction of the peripheral surface of the image bearing member. It is to control the charge bias applied to the second charging means of the contact type, counting from the downstream side, that is particularly effective.

Also in the preceding embodiments, the magnetic brush-based charging devices were employed as the charging means. However, the choice of the charging means does not need to be limited to a magnetic brush-based charging device. For example, the present invention is also applicable to an image forming apparatus employing two or more charging devices, which comprise a charge roller made up of a foamed elastic substance, and electrically conductive particles, and which injects electric charge to an image bearing member through the electrically conductive particles coated on the peripheral surface of the charge roller made up of a foamed elastic substance.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 134014/2005 and 094437/2006 filed May 2, 2005 and Mar. 30, 2006 respectively, which are hereby incorporated by reference.

What is claimed is:

1. An image forming apparatus comprising:

an image bearing member;

a plurality of chargers for injection charging of said image bearing member;

a latent image forming device, disposed downstream of said plurality of charging members with respect to a moving direction of a peripheral surface of said image bearing member, for forming a latent image on said image bearing member having been charged by said plurality of charging members;

a potential detecting device for detecting a surface potential of said image bearing member after passing by said plurality of charging members, wherein said plurality of chargers include a first charger and a second charger disposed at a most downstream position with respect to the moving direction; and a control device for changing bias voltages applied to said first charger and to said second charger, wherein said control device is capable of changing a bias voltage applied to said first charger without changing a bias voltage applied to said second charger in accordance with a detection result of said potential detecting device.

2. An apparatus according to claim 1, wherein said control device carries out a control operation between adjacent image formations during continuous image formations.

3. An apparatus according to claim 1, wherein said control device carries out a control operation when a potential of said image bearing member changes within a range less than 5V in absolute value from a predetermined potential.

4. An apparatus according to claim 1, wherein the bias voltages are DC voltages.

5. An apparatus according to claim 1, wherein the bias voltages are voltage duty ratios.

6. An apparatus according to claim 1, wherein the bias voltages are voltage amplitudes.

7. An apparatus according to claim 1, wherein each of said first charger and said second charger includes a magnetic particle carrying member for magnetically carrying magnetic particles, and wherein the magnetic particles are contacted to said image bearing member to charge said image bearing member.

8. An apparatus according to claim 1, wherein said image bearing member is a photosensitive member comprising amorphous silicon.

9. An apparatus according to claim 1, wherein said control device is capable of effecting a second control in which a bias voltage applied to said second charger is changed in accordance with the detection result of said potential detecting device.

* * * * *